US009850054B2

(12) United States Patent
Pansegrouw

(10) Patent No.: US 9,850,054 B2
(45) Date of Patent: Dec. 26, 2017

(54) MANIFOLD ARRANGEMENT

(71) Applicant: VORTEX INNOVATION WORX (PTY) LTD, Ottery (ZA)

(72) Inventor: Bester Jacobus Pansegrouw, Ottery (ZA)

(73) Assignee: VORTEX INNOVATION WORX (PTY) LTD, Ottery (ZA)

( * ) Notice: Subject to any disclaimer, the term of this patent is extended or adjusted under 35 U.S.C. 154(b) by 0 days.

(21) Appl. No.: 14/903,413

(22) PCT Filed: Jun. 13, 2014

(86) PCT No.: PCT/IB2014/062196

§ 371 (c)(1),
(2) Date: Jan. 7, 2016

(87) PCT Pub. No.: WO2015/004549

PCT Pub. Date: Jan. 15, 2015

(65) Prior Publication Data

US 2016/0152395 A1 Jun. 2, 2016

(30) Foreign Application Priority Data

Jul. 9, 2013 (ZA) ..... 2013/05137

(51) Int. Cl.
*B65D 77/06* (2006.01)
*B65D 81/05* (2006.01)

(52) U.S. Cl.
CPC ..... *B65D 77/065* (2013.01); *B65D 81/052* (2013.01)

(58) Field of Classification Search
CPC ..... B65D 77/065; B65D 81/052
USPC ..... 222/105, 95, 394, 399, 386, 386.5, 398, 222/464.1, 464.2
See application file for complete search history.

(56) References Cited

U.S. PATENT DOCUMENTS 4,258,863 A * 3/1981 Ness ..... B65D 77/40 206/222
4,524,458 A * 6/1985 Pongrass ..... B65D 77/06 220/86.1
4,603,793 A * 8/1986 Stern ..... B65D 75/5872 222/105
5,335,820 A 8/1994 Christianson
5,407,099 A * 4/1995 Heuke ..... B67B 7/26 222/83
5,566,851 A * 10/1996 Sasaki ..... B65D 77/06 222/105

(Continued)

OTHER PUBLICATIONS

International Search Report for PCT/IB2014/062196 dated Sep. 1, 2014.

*Primary Examiner* — Donnell Long
(74) *Attorney, Agent, or Firm* — Stephen J. Weyer, Esq.; Stites & Harbison, PLLC

(57) ABSTRACT

The invention discloses a manifold arrangement for bulk handling of fluid material having an inner bag for holding fluid material, which includes a manifold member adapted to be located within the inner bag, the inner bag having a product inlet through which fluid material can be introduced into the inner bag and a product outlet through which the fluid material can flow from the inner bag, and being adapted to assist in forcing fluid material out of the inner bag through the product outlet and thereby reducing residue in the inner bag.

22 Claims, 3 Drawing Sheets

(56) References Cited

U.S. PATENT DOCUMENTS

| | | | | |
|---|---|---|---|---|
| 5,866,186 | A | 2/1999 | Bazan | |
| 7,954,670 | B2 | 6/2011 | Stuart | |
| 9,371,167 | B2 * | 6/2016 | Ortiz-Hernandez ... | B65D 25/38 |
| 2006/0086753 | A1 | 4/2006 | Newton | |
| 2008/0302819 | A1 * | 12/2008 | Stuart ..... | B65D 77/06 222/95 |
| 2008/0310766 | A1 | 12/2008 | Plunkett et al. | |

* cited by examiner

MANIFOLD ARRANGEMENT

FIELD OF INVENTION

The present invention relates to a manifold arrangement.

More particularly, the present invention relates to a manifold arrangement for packaging arrangements for fluids, pastes and powders.

BACKGROUND TO INVENTION

Various types of packaging are known for transporting or storing liquids such as food products and chemicals. These food products and chemicals are either emptied by means of devices, such as pumps or pressure devices, or are self-emptying due to gravity.

Unfortunately there are problems in completely and effectively emptying such packaging arrangements.

It is an object of the invention to suggest a novel manifold arrangement for over-coming the above problems.

SUMMARY OF INVENTION

According to the invention, a manifold arrangement for bulk handling of fluid material having an inner bag for holding fluid material, includes a manifold member adapted to be located within the inner bag, the inner bag having a product inlet through which fluid material can be introduced into the inner bag and a product outlet through which the fluid material can flow from the inner bag, and being adapted to assist in forcing fluid material out of the inner bag through the product outlet and thereby reducing residue in the inner bag.

Also according to the invention, a packaging arrangement for bulk handling of fluid material and being adapted to be located within an outer box and/or container, includes (a) an inner bag adapted to hold fluid material, the inner bag having a product inlet through which fluid material can be introduced into the inner bag and a product outlet through which fluid material can flow from the inner bag;

(b) a surrounding member adapted to surround the inner bag and adapted to form at least one air pocket or air compartment between the surrounding member and the inner bag, the pocket having an air inlet through which air can be introduced into the pocket and thereby putting pressure on the inner bag to force the fluid material out of the inner bag through the product outlet; and (c) a manifold arrangement located within the inner bag to assist in forcing the fluid material out of the inner bag through the product outlet and thereby reducing residue in the inner bag.

Yet further according to the invention, a manifold arrangement for the bulk handling of fluid material, includes a loose manifold member placed and mounted inside an inner bag of an air-assist bag in final stages of the bag assembly process with the inner bag closed off with the manifold member inside, packed and shipped to customer ready to use.

The main function of the manifold arrangement may be to reduce the residual in the bag during discharging or decanting of fluid material.

During the decanting process the material of the bag may be folding on each other at the bottom of Intermediate Bulk Container (IBC) and create pockets where product is trapped. This increases the residual fluid material as all the products cannot be pumped out of the bag.

The manifold arrangement serves the purpose of keeping the folded material open during the decanting process and allowing the pump to pump the remainder of product through the manifold during the last stages of decanting and thereby reducing the final residual fluid in bag.

A surrounding member may surround the inner bag and be adapted to form at least one air pocket or air compartment between the surrounding member and the inner bag, the pocket having an air inlet through which air can be introduced into the pocket and thereby allowing putting pressure on the inner bag to force fluid material out of the inner bag through the product outlet.

The manifold arrangement may be a loose device inserted into the inner bag.

The manifold arrangement may consist of plastics material.

The manifold arrangement may consist of an inert material.

The manifold arrangement may be injection moulded.

The manifold arrangement may be a one-piece integrally formed object.

The packaging arrangement may be flexible.

The surrounding member may consist of at least two layers.

The surrounding member may have 7 air pockets or air compartments.

The packaging arrangement may have a bladder shape.

The packaging arrangement may consist of transparent material to enable the fluids, pastes and/or powders to be visible from the outside.

The box and/or container may be an intermediary bulk container (IBC).

The packaging arrangement may be a liquid liner.

The fluid material may be powdery, paste-like, fluids and/or liquids.

The intermediate bulk container may have a capacity of 50 to 500 gallons or about 189 to 2000 litres.

The invention also extends to a method for delivering bulk material and a method for producing the manifold arrangement as described herein.

BRIEF DESCRIPTION OF DRAWINGS

The invention will now be described by way of example with reference to the accompanying schematic drawing.

In the drawings there is shown in.

DETAILED DESCRIPTION OF DRAWINGS

Figure 1:
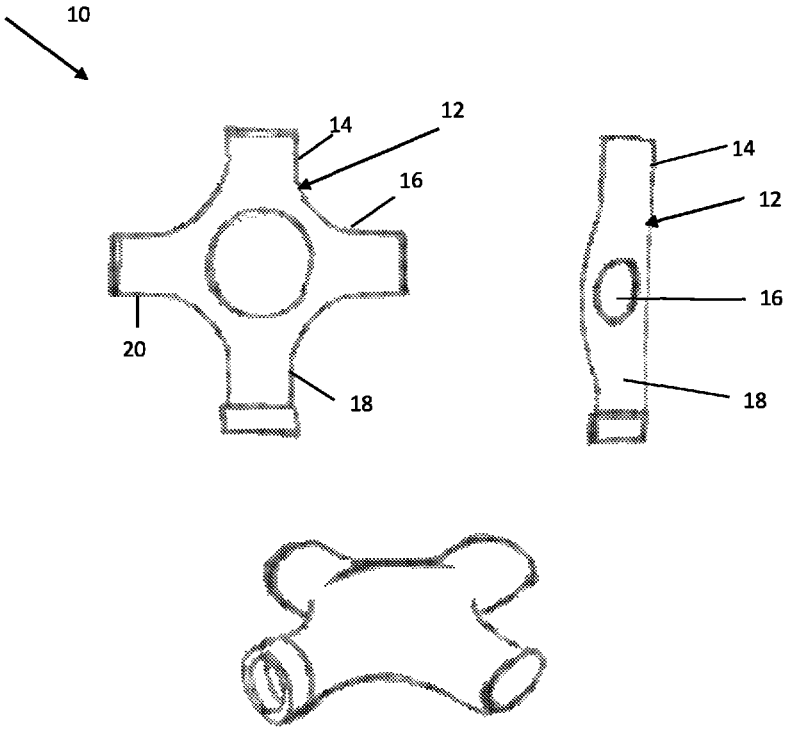
FIG. 1: various views of the manifold arrangement in accordance with the invention.
Figure 2:
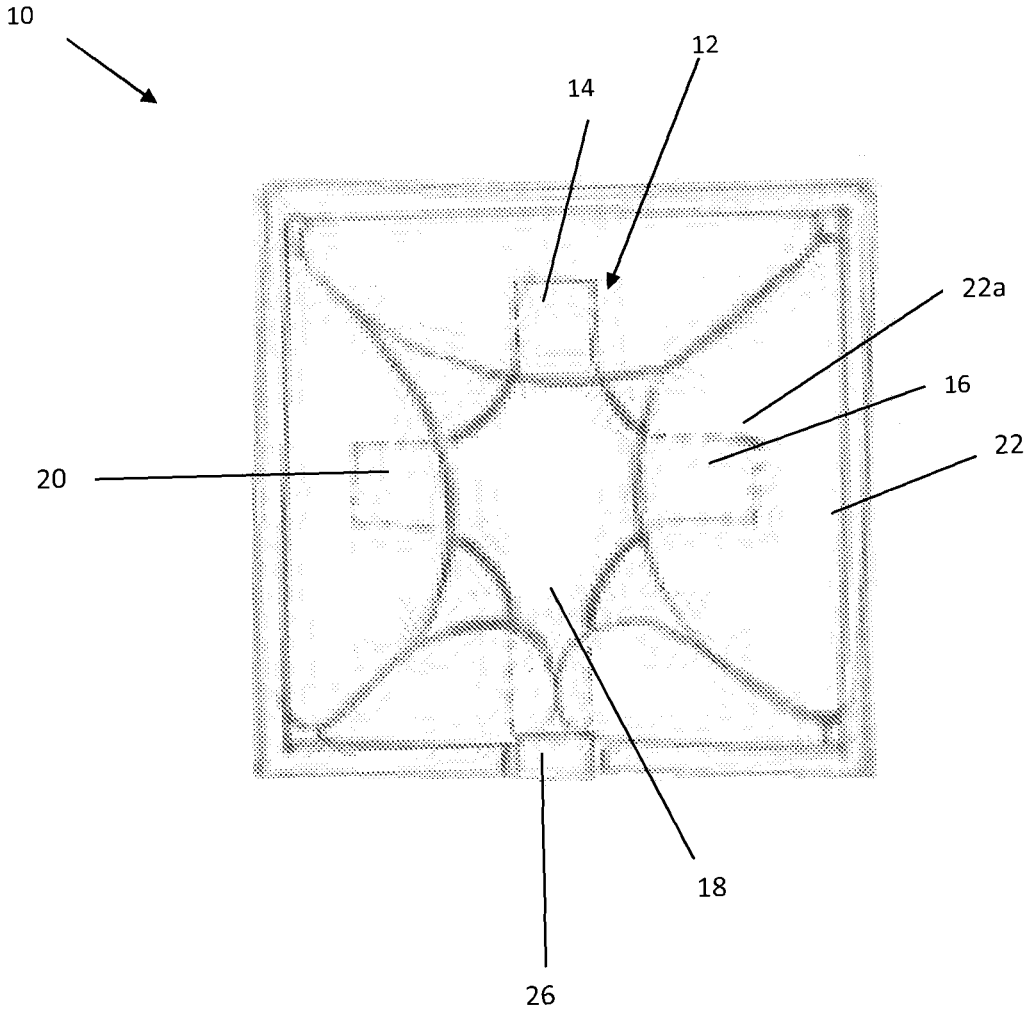
FIG. 2: a sectional top view of a packaging arrangement in which the manifold is located.
Figure 3:
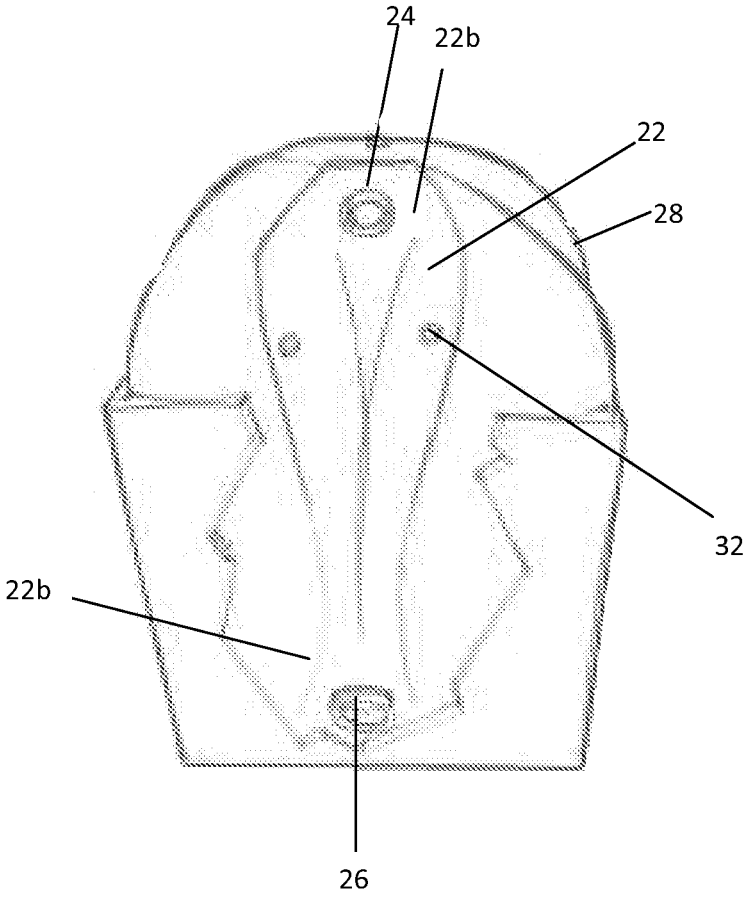
FIG. 3: a front perspective view of the packaging arrangement shown in FIG. 2 with a section of the box or container cut-out to show the product outlet.

Referring to the Figures, a manifold arrangement for intermediate bulk containers in accordance with the invention, generally indicated by reference numeral 10, is shown.

The manifold arrangement 10 for the bulk handling of fluid material includes a manifold member 12 having four tubular legs 14, 16, 18, 20. It can, however, have any number of legs. The manifold member 12 is adapted to be located within an inner bag 22 on its bottom surface 22*a* for holding fluid material.

The inner bag 22 has a product inlet 24 on its side surface 22*b* through which the fluid material can be introduced into the inner bag 22 and a product outlet 26 to the surface 22*b*through which the fluid material can flow from the inner bag 22, and being adapted to assist in forcing the fluid material out of the inner bag 22 through the product outlet 26.

A surrounding member 28 surrounds the inner bag 22 and is adapted to form at least one air pocket or air compartment between the surrounding member 28 and the inner bag 22. The pocket has an air inlet through which air can be introduced into the pocket and thereby putting pressure on the inner bag 22 to force the fluid material out of the inner bag 22 through the product outlet 26.

The manifold arrangement 10 is a loose part placed and mounted inside the inner bag 22 on bottom surface 22*a* in the final stages of the inner bag assembly process. The inner bag will be closed off with manifold arrangement 10 inside, packed and shipped to a customer ready to use. The main function of the manifold arrangement 10 is to reduce the residual fluid material in the inner bag 22 during the decanting process. During the decanting process the lining of the inner bag 22 folds on the bottom of the Intermediate Bulk Container (IBC) and creates pockets in which product is trapped. This increases the residual of the fluid material which cannot be pumped out of the inner bag. The manifold arrangement 10 in this case will serve the purpose of keeping the folded lining open during the decanting process and allowing the pump to pump the remainder of fluid material through the manifold arrangement during the last stages of decanting. This will reduce the final residual fluid material in inner bag.

As mentioned above, the manifold arrangement 10 is a loose device inserted into the inner bag.

The manifold arrangement 10 consists of plastics material.

The manifold arrangement 10 consists of an inert material.

The manifold arrangement 10 can be injection moulded.

The manifold arrangement 10 can be a one-piece integrally formed object.

The packaging arrangement is flexible.

The surrounding member consists of at least two layers.

The surrounding member can have various air pockets or air compartments.

The packaging arrangement has a bladder shape.

The packaging arrangement consists of transparent material to enable the fluids, pastes and/or powders to be visible from the outside.

The box and/or container is an intermediary bulk container (IBC).

The packaging arrangement is a liquid liner.

The fluid material can be powdery, paste-like, fluids and/or liquids.

The intermediate bulk container can have a capacity of 50 to 500 gallons or about 189 to 2000 litres.

The invention provides for a manifold arrangement for a packaging arrangement for the bulk handling of fluid material and being adapted to be located within an outer box and/or container, which includes (a) an inner bag adapted to hold fluid material, the inner bag having a product inlet through which the fluid material can be introduced into the inner bag and a product outlet through which the fluid material can flow from the inner bag;

(b) a surrounding member adapted to surround the inner bag and adapted to form at least one air pocket or air compartment between the surrounding member and the inner bag, the pocket having an air inlet through which air can be introduced into the pocket and thereby putting pressure on the inner bag to force the fluid material out of the inner bag through the product outlet; and (c) a manifold arrangement located within the inner bag to assist in forcing the fluid material out of the inner bag through the product outlet.

The invention claimed is:

1. A manifold arrangement for bulk handling of fluid material having an inner bag for holding fluid material, and a loose manifold member disposed within the inner bag, the inner bag having a product inlet through which fluid material can be introduced into the inner bag and a product outlet through which the fluid material can flow from the inner bag, and being adapted to assist in forcing fluid material out of the inner bag through the product outlet and thereby reducing residue in the inner bag.

2. An arrangement as claimed in claim 1, wherein the manifold member is adapted to reduce the residual in the bag during discharging or decanting of fluid material.

3. An arrangement as claimed in claim 1, wherein the manifold member is adapted to keep the folded material open during the decanting process and allowing the pump to pump the remainder of product through the manifold during the last stages of decanting and thereby reducing the final residual fluid in bag.

4. An arrangement as claimed in claim 1, in which a surrounding member surrounds the inner bag and be adapted to form at least one air pocket or air compartment between the surrounding member and the inner bag, the pocket having an air inlet through which air can be introduced into the pocket and thereby allowing putting pressure on the inner bag to force fluid material out of the inner bag through the product outlet.

5. An arrangement as claimed in claim 4, in which the surrounding member consists of at least two layers.

6. An arrangement as claimed in claim 4, in which the surrounding member has seven air pockets or air compartments.

7. An arrangement as claimed in claim 1, wherein the manifold member is disposed on a bottom surface of the inner bag and said outlet is disposed on a side of the inner bag extending upwards from said bottom.

8. An arrangement as claimed in claim 1, wherein the manifold arrangement consists of plastics material.

9. An arrangement as claimed in claim 1, wherein the manifold arrangement consists of an inert material.

10. An arrangement as claimed in claim 1, wherein the manifold arrangement is injection moulded.

11. An arrangement as claimed in claim 1, wherein the manifold arrangement is a one-piece integrally formed object.

12. A packaging arrangement for bulk handling of fluid material and being adapted to be located within an outer box and/or container, includes (a) an inner bag adapted to hold fluid material, the inner bag having a product inlet through which fluid material can be introduced into the inner bag and a product outlet through which fluid material can flow from the inner bag;

(b) a surrounding member adapted to surround the inner bag and adapted to form at least one air pocket or air compartment between the surrounding member and the inner bag, the pocket having an air inlet through which air can be introduced into the pocket and thereby putting pressure on the inner bag to force the fluid material out of the inner bag through the product outlet; and (c) a manifold arrangement disposed loosely within the inner bag to assist in forcing the fluid material out of the inner bag through the product outlet and thereby reducing residue in the inner bag.

13. A packaging arrangement as claimed in claim 12, wherein the inner bag and surrounding member are fexible.

14. A packaging arrangement as claimed in claim 12, wherein the inner bag has a bladder shape.

15. A packaging arrangement as claimed in claim 12, wherein the inner bag consists of transparent material to enable fluids, pastes and/or powders to be visible from the outside.

16. A packaging arrangement as claimed in claim 12, in which the box and/or container is an intermediary bulk container (IBC).

17. A packaging arrangement as claimed in claim 16, in which the intermediate bulk container has a capacity of 50 to 500 gallons or about 189 to 2000 liters.

18. A packaging arrangement as claimed in claim 12, wherein the inner bag is a liquid liner.

19. A packaging arrangement as claimed in claim 12, in which the fluid material is powdery, paste-like and/or liquid.

20. The packaging arrangement of claim 12, wherein the manifold arrangement is disposed on a bottom surface of the inner bag and said product outlet is disposed on a side of the inner bag extending upwards from said bottom.

21. A manifold arrangement for the bulk handling of fluid material, which includes a manifold member loosely disposed inside an inner bag of an air-assist bag in final stages of the bag assembly process with the inner bag closed off with the manifold member inside, packed and shipped to customer ready to use.

22. The manifold arrangement of claim 21, wherein the manifold member is disposed on a bottom surface of the inner bag and an outlet is disposed on a side of the inner bag extending upwards from said bottom.

* * * * *